United States Patent [19]

Toda et al.

[11] 4,266,497

[45] May 12, 1981

[54] MARINE STEERING ARRANGEMENT

[75] Inventors: Kashiku Toda; Moriji Honda, both of Nagasaki; Haruhiko Mishina, Isahaya, all of Japan

[73] Assignee: Mitsubishi Jukogyo Kabushiki Kaisha, Tokyo, Japan

[21] Appl. No.: 950,621

[22] Filed: Oct. 12, 1978

[30] Foreign Application Priority Data

Oct. 29, 1977 [JP] Japan ..... 52/129858

[51] Int. Cl.[3] ..... B63H 25/00

[52] U.S. Cl. ..... 114/144 R

[58] Field of Search ..... 114/144 R, 144 E, 150; 244/78, 85; 180/132

[56] References Cited

U.S. PATENT DOCUMENTS

| | | | |
|---|---|---|---|
| 2,455,090 | 11/1948 | Pritchard | 114/150 |
| 2,892,310 | 6/1959 | Mercier | 114/150 |
| 3,464,319 | 9/1969 | Sherman et al. | 244/78 |

FOREIGN PATENT DOCUMENTS

| | | | |
|---|---|---|---|
| 51-846268 | 6/1976 | Japan | 114/150 |

*Primary Examiner*—Trygve M. Blix
*Assistant Examiner*—Jesus D. Sotelo
*Attorney, Agent, or Firm*—Wenderoth, Lind & Ponack

[57] ABSTRACT

A marine steering arrangement which includes a hydraulic steering machine, variable discharge type pump units for actuating the hydraulic steering machine and power units for remotely manipulating the pump units. The power units are provided respectively in at least two channels which includes a spare channel. Additionally, a mechanical control for mechanically coupling the pump units to the power units to control the pump units and mechanically receive a feedback of an amount of steering done by the steering machine is provided in the at least two channels which include a spare channel. Further, there are hydraulic coupling/decoupling devices interposed in control force transmission systems in the mechanical control, each of which can be switched between a first state for transmitting a control force and a second state for not transmitting a control force.

4 Claims, 13 Drawing Figures

MARINE STEERING ARRANGEMENT

BACKGROUND OF THE INVENTION

The present invention relates to a marine steering arrangement for effecting steering by actuating a hydraulic steering machine through remote manipulation, and more particularly, to a marine steering arrangement in which systems for actuating the steering machine are provided in at least two channels.

One marine steering arrangement in the prior art is illustrated in FIG. 1, in which a steering signal for a rudder, for steering either in the starboard direction, or in the port direction is applied from a bridge to a power unit 17 or 17' in a steering machine chamber through remote manipulation to cause a piston rod 17-2 or 17'-2 to move in a stroke in the direction of arrow a. This motion is transmitted and converted, via an intermediate rod 17-3, or 17'-3 to a manipulation arm system 15 as a rotational motion in the direction of arrow b.

It is noted that in this case, a pin 15-4 for coupling a manipulation arm 15-5 onto the side of a mechanical handle 16-1 is removed.

As a result, the rotary motion of the manipulation arm system 15 is converted into a linear motion in the direction of arrow c of a manipulation rod system 14, and is transmitted to a floating arm 13-1.

At this time, since the rotation of the floating arm 13-1 has a center of rotation about a fulcrum B, pump control rods 11-1 and 11'-1 are caused to move linearly in the direction of arrow d by the floating arms 13-2, 13-3 and 13-4.

As a result, control levers 1-3 and 1'-3 for controlling the discharge rates and discharge directions of variable discharge type pumps 1-1 and 1'-1, respectively, in the respective pump units 1 and 1', are rotated as shown by arrow e.

Accordingly, the pump 1-1 or 1'-1 discharges pressurized oil into pipes 9-1 or 9-2, respectively, and sucks the oil from pipes 8-1 or 8-2, respectively. The discharged pressurized oil is fed through pipes 9-3, 9-4 and 9-5 to hydraulic cylinders 2-1 and 2-2 so as to act upon rams 4-1 and 4-2, respectively.

Thereby the respective rams 4-1 and 4-2 undergo linear motion, and at the same time, the linear motion is converted into a rotational motion, in the direction of arrow f, by a tiller 5. Further, the rotational motion is transmitted to a rudder axle 7 via a rudder axle key 6, and as a result, a rudder plate is rotated in the direction of arrow f.

In addition, oil within hydraulic cylinders 3-1 and 3-2 is discharged through pipes 8-1 through 8-5 due to the linear motion of the rams 4-1 and 4-2, and is sucked by an operating pump 1-1 or 1'-1.

Further, the rotational motion of the tiller 5 is also transmitted to a tracing rod 10 which has a spring 10*a*, associated therewith, and its linear motion in the direction of arrow g is converted into the rotational motion of the floating arm 13-1 about a fulcrum at point A. This results in pump control rods 11-1 and 11'-1 moving linearly in the direction opposite to arrow d by means of the floating arms 13-2 through 13-4, so that the pump control levers 1-3 and 1'-3 are returned to their neutral positions.

In response to the restoration of the respective pump control levers 1-3 and 1'-3 to their neutral positions, the pump 1-1 or 1'-1 stops its discharge-suction effects, and as a result, the rotation of the tiller 5 is stopped.

More particularly, the rudder is steered by an amount corresponding to the steering command signal which is issued from the bridge and transmitted to the marine steering arrangement from the bridge (the magnitude of stroke of the piston rod 17-2 or 17'-2 of the power cylinder 17-1 or 17'-1).

It is noted that in the case where the piston rod 17-2 or 17'-2 in the respective power unit 17 or 17', is actuated in the direction opposite to arrow a, the operation can be explained exactly in the same manner as before.

In addition, in the situation case where steering is effected by means of the mechanical handle 16-1 in the steering machine chamber, the pin 15-3 is removed after the pin 15-4 has been inserted, and by rotating the mechanical handle 16-1 in the direction of arrow h, a threaded shaft 16-2 in a mechanical handle transmission system 16 is rotated. As a result, the manipulation arms 15-5 and 15-1 can thus be rotated in the direction of arrow b. It is further noted that the operation of the other mechanical control means associated with the aforedescribed mechanical handle operation, is similar to that in the case of the remote manipulation.

However, in the type of marine steering arrangement shown in the prior art, although there are provided pump units 1 and 1' for a steering machine, associated devices including power units 17 and 17', remote manipulation devices from a bridge, and piping systems, in two channels which include a spare channel, a mechanical control means (manipulating and tracing means) which connects the power units 17 and 17', in these remote manipulation devices, to the pump units 1 and 1', respectively, for the steering machine, is not available in the two channels. More particularly, except for the intermediate rods 17-3 and 17'-3 which are connected to the piston rods 17-2 and 17'-2 for the power units, and the control rods 11-1 and 11'-1 which are connected to the pump control levers 1-3 and 1'-3, the mechanical means such as the floating arm system 13, manipulation rod system 14, and manipulation arm system 15, etc., are found only in one channel. As a result, if any problems occur in these systems, it would become impossible to control the pump 1-1 or 1'-1 and thereby, steering would become impossible. Thus there is a possiblity of causing a serious accident such as the collision of ships.

Accordingly, although a 2-channel system having a spare circuit which includes remote manipulation means, hydraulic pump units 1 and 1', etc., is employed as described above, if the manipulating and tracing means in the mechanical control means for coupling these control systems is provided in only one channel and not in a spare channel, then the efficacy of the aforedescribed two channels wil be reduced, and further, if the entire steering system comprises a mere two channels assembled in parallel, then there exists a problem that even if only one unit in the channel should become faulty, the entire channel with which the faulty unit is associated would become impossible to use, and so, the relative importance of a trouble in one unit would become very large.

SUMMARY OF THE INVENTION

The present invention is directed at resolving these problems, and has, as an object, to provide a marine steering arrangement in which the system for actuating a steering machine through remote manipulation is provided in two or more channels so that a great improvement in the reliability of the steering apparatus is achieved.

As a result, the marine steering arrangement according to the present invention is characterized in that the arrangement includes variable discharge type pump units for actuating a hydraulic steering machine and power units for remotely manipulating the pump units respectively in at least two channels which include a spare channel. The arrangement also includes mechanical control means for mechanically coupling the pump units to the power units to thereby control the pump units and mechanically receive a feedback of an amount of steering accomplished by the steering machine in the at least two channels which include a spare channel. Control force transmission systems which are located in said mechanical control means have hydraulic coupling/decoupling devices interposed therein, each of which can be switched between a state wherein they are capable of transmitting a control force and a state wherein they are not capable of transmitting a control force.

BRIEF DESCRIPTION OF THE DRAWINGS

The above-described and other features and objects of the present invention will become more apparent by reference to the following description taken in conjunction with the accompanying drawings, in which.

DETAILED DESCRIPTION OF THE INVENTION

Figure 2:
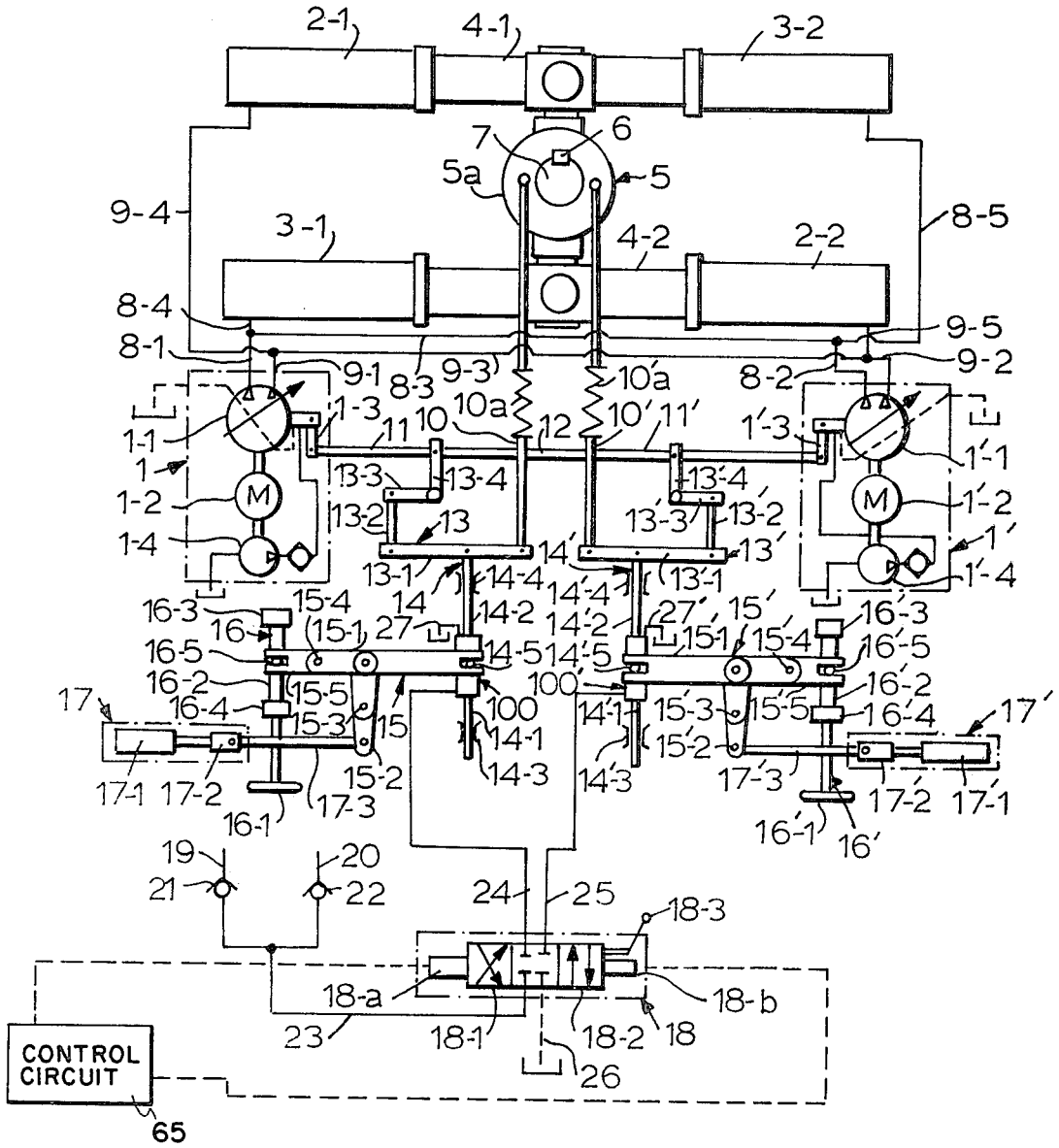
FIG. 2 is a schematic view of the marine steering arrangement of the present invention.
Figure 3:
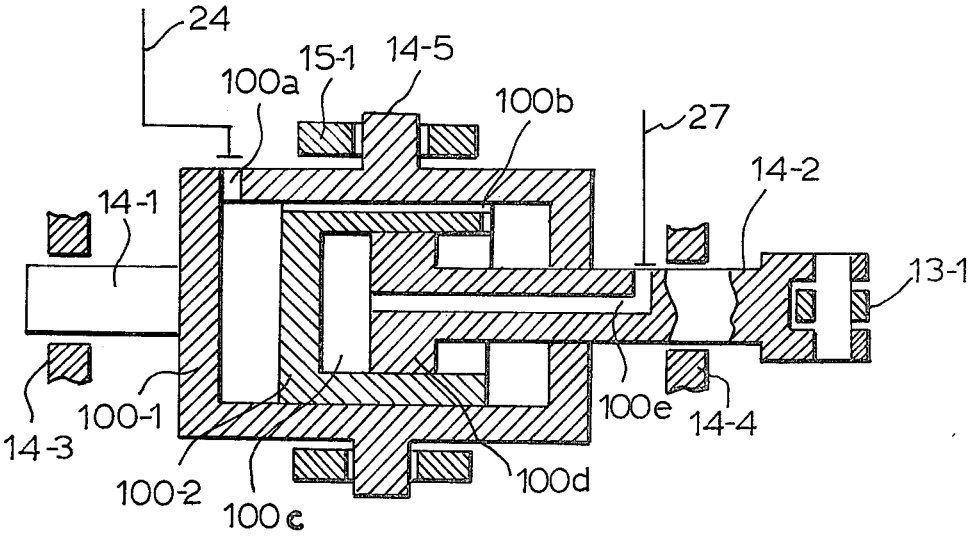
FIGS. 3 and 4 are longitudinal cross-section views of a hydraulic coupling/decoupling device of the steering arrangement of the present invention, FIGS. 5 through 10, respectively, are schematic views showing marine steering arrangements according to second through seventh embodiments of the present invention.
Figure 4:
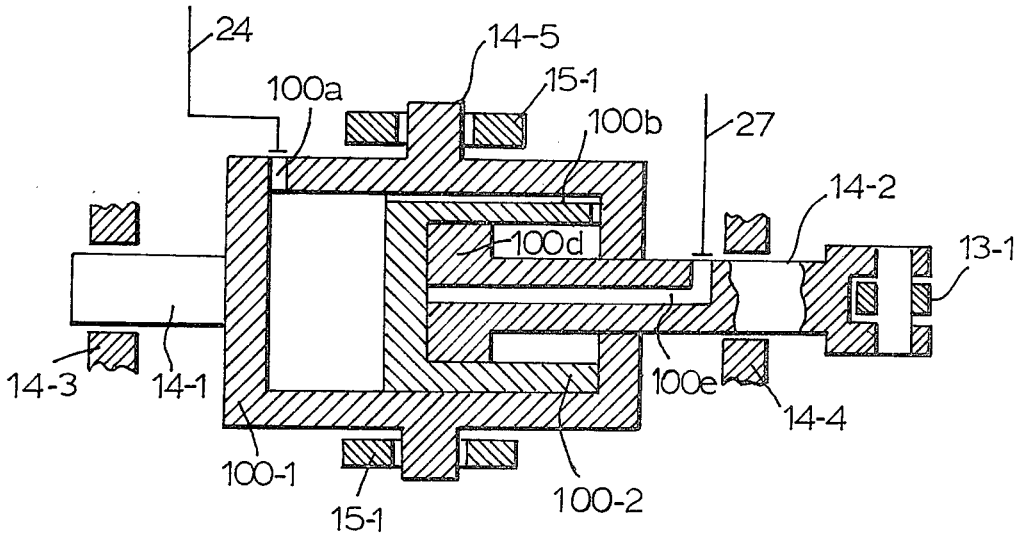

The present invention will now be described in greater detail in connection to its preferred embodiments with reference to FIGS. 2 through 13 of the accompanying drawings. A first preferred embodiment of the invention is illustrated in FIGS. 2 to 4, FIG. 2 being a schematic view of the marine steering arrangement, and FIGS. 3 and 4 being longitudinal cross-section views of a hydraulic coupling/decoupling device in the arrangement. In FIG. 2, a variable discharge type pump 1-1 is provided in a pump unit. The variable discharge type pump 1-1 is adapted to be actuated by a motor 1-2. The pump 1-1 is also associated with a pump control lever 1-3 which is used for controlling a discharging rate by manipulation of a slant plate of the pump 1-1.

Further, there is an auxiliary pump 1-4 provided in the variable discharge type pump unit. The auxiliary pump 1-4 is also coupled to the motor 1-2 so as to be driven by the motor 1-2.

In addition, besides the pump unit 1, there is provided another pump unit 1', which is constructed in a manner similar to the pump unit 1.

A steering machine actuator includes hydraulic cylinders 2-1, 2-2 and 3-1, 3-2, and rams 4-1 and 4-2 which are driven by the respective hydraulic cylinders. The steering machine actuator also includes a tiller 5 which is coupled between the respective rams 4-1 and 4-2.

Furthermore, a rudder axle 7 is inserted in a tiller boss **5*a* of the tiller 5 and held therein by a rudder axle key 6, and further, on this rudder axle 7** is mounted a rudder plate which is not shown.

The respective ports of the pumps 1-1 and 1'-1, and the respective hydraulic cylinders 2-1, 2-2, 3-1 and 3-2 are connected so to be in communication with each other by means of pipes 8-1 through 8-5, and 9-1 through 9-5.

There is a mechanical control means interposed between the pump unit 1 and a power unit 17 for controlling the pump unit 1 by remote manipulation. The mechanical control means is adapted to mechanically couple the respective units 1 and 17 and further, to mechanically receive a feedback resulting from an amount of steering, by means of the steering machine actuator.

More particularly, the mechanical control means has a control rod 11 which is connected to a pump control lever 1-3 of the pump unit 1, and a floating arm system 13 which is connected to the control rod. The mechanical control means further includes a manipulation rod system 14 which is connected to a floating arm 13-1 in the floating arm system 13, and a manipulation arm system 15 which is connected to the manipulation rod system 14. The manipulation arm system 15 is also connected to the power unit 17.

It is noted that the aforedescribed respective control force transmission systems 11, and 13 through 15, in the mechanical control means, are all mechanically connected.

In addition, the mechanical control means has a tracing rod 10 associated with a spring **10*a*. The tracing rod 10 has one end mounted on the tiller boss 5*a* and the other end mounted on an end portion of the floating arm 13-1** so that a feedback of an amount of steering, can be mechanically transmitted.

It is noted that the spring **10*a*** is capable of both completely absorbing an abnormal feedback amount as well as transmitting a normal feedback amount without any difficulty.

With reference to FIG. 2, there is a hydraulic coupling/decoupling device 100 interposed in the manipulation rod system 14. The device 100 includes, as shown in FIGS. 3 and 4, a cylinder member 100-1 which is provided with an oil injecting and ejecting port **100*a*, and a free piston 100-2 that is freely slidable within the cylinder member 100-1 and which is provided with a communication port 100*b***.

There is a rod 14-1, in the manipulation rod system 14, which is mounted on the cylinder member 100-1. Further, there is a recess **100*c* in the free piston 100-2 which defines a cylinder portion, and there is a rod 14-2, having a piston portion 100*d* fitted in the recess 100*c***.

In addition, there is an oil path **100*e* in the manipulation rod 14-2 for allowing communication of the recess 100*c*** with the exterior.

Accordingly, if pressurized oil is fed through the oil injecting and ejecting port **100*a* in the state where the manipulation rod 14-2 can slide freely as shown in FIG. 3, then the free piston 100-2** and the manipulation rod 14-2 will move while ejecting the oil within the recess 100*c* through the oil path 100*e*. Therefore, the manipulation rods 14-1 and 14-2 are fixedly joined as if they were a single rod, as shown in FIG. 4.

It is noted that as shown in FIG. 2, the manipulation arm system 15 is provided with a mechanical handle transmission system 16.

In the respective control force transmission systems 13 to 16, members, which are represented by reference numerals having suffixes, are constituent members in the respective transmission systems. More particularly, reference numerals 13-1 through 13-4 designate floating arms, numerals 14-1 and 14-2 designate manipulation rods, numerals 15-1, 15-2 and 15-5 designate manipulation arms, numerals 15-3 and 15-4 designate pins and numeral 16-1 designates a mechanical handle The power unit 17 is composed of a power cylinder 17-1, a piston rod 17-2 for transmitting the force generated by the power cylinder 17-1, and an intermediate rod 17-3.

There is a mechanical control means provided between the pump unit 1′ and the power unit 17′. The mechanical control means includes control force transmission systems 10′, 11′, 13′ through 16′ which are similar to those described above. Further, there is a hydraulic coupling/decoupling device 100′ interposed in the manipulation rod system 14′.

There is a connecting rod 12 interposed between the control rods 11 and 11′ in the respective mechanical control means for correlating the operation of the mechanical control means to each other.

In addition, there is provided an electromagnetic valve 18 for controlling the feeding of pressurized oil to the respective coupling/decoupling devices 100, and 100′ to switch these coupling/decoupling devices between a coupling state, (a state capable of transmitting a control force from the transmission system 14′ or 14′), and a decoupling state, (a state not capable of transmitting the same control force). The electromagnetic valve is connected through pipes 19 and 20, check valves 21 and 22 and a pipe 23, to the auxiliary pumps 1-4 and 1′-4 which serve as sources of pressurized oil.

There are pipes 24 and 25 interposed between the electromagnetic valve 18 and the coupling/decoupling devices 100 and 100′.

In addition, the electromagnetic valve 18 is provided with electromagnetic coils 18-*a* and 18-*b* so that the electromagnetic valve 18 is adapted to be held at a position 18-1 in response to excitation of the electromagnetic coil 18-*a*, and to be held at a position 18-2 in response to excitation of the electromagnetic coil 18-*b*. Further, the electromagnetic valve 18 is adapted to be electrically actuated in relation to a starting and stopping of the power unit 17 or 17′ due to operation of a control circuit which is not shown.

Reference numerals 26, 27 and 27′ designate return pipes to an oil tank, and numeral 18-3 designates a mechanical lever.

Since the marine steering arrangement according to the present invention is constructed as described above, explaining the operation thereof with respect to the case where the pump 1 and the power unit 17 are used in combination, for instance, when the pump unit 1 for driving a steering machine and a pump for the power unit 17 have been started the electromagnetic coil 18-*b* of the electromagnetic valve 18 is excited in relation thereto to thereby hold the electromagnetic valve at its position 18-2. As a result, the pressurized oil fed from the auxiliary pump 1-4, in the pump unit 1, is passed through the pipe system and check valves, 19, 21, 23 and 24, and is fed into the cylinder member 100-1 which is disposed at an end portion of the rod 14-1 in the manipulation rod system 14 which is associated with the hydraulic coupling/decoupling device 100.

The pressurized oil fed into the cylinder member 100-1 acts upon the piston portion 100*d*, which is positioned at an end portion of the other rod 14-2, and the free portion 100-2, as shown in FIGS. 3 and 4, so that the state shown in FIG. 3 changes to the state shown in FIG. 4, and thereby, the respective rods 14-1 and 14-2 are held together by the pressurized oil acting on them so that they form a single rod.

On the other hand, the oil within the cylinder member which is located at an end portion of the rod 14′-1 in the other manipulation rod system 14′ which is associated with the other hydraulic coupling/decoupling device 100′, is passed, in order, through the pipe 25, the electromagnetic valve 18 at the position 18-2 and the return pipe 26 and then released into a tank.

As a result, the respective rods 14′-1 and 14′-2 in the manipulation rod system 14′ are able to move freely by an amount of stroke of the free piston which is provided within the cylinder member at an end portion of the rod 14′-1, and therefore, the respective rods 14′-1 and 14′-2 can move freely without affecting each other.

If a steering signal is applied from a bridge to the hydraulic steering arrangement of the above-described condition, then, as shown in FIG. 2, the piston rod 17-2 in the power unit 17 moves by a corresponding stroke, and the stroke motion is converted into a rotary motion of the manipulation arm 15-2, by means of the intermediate rod 17-3, and is further transmitted through the pin 15-3 in the form of a rotational motion of the manipulation arm 15-1.

Subsequently, the rotational motion of the manipulation arm 15-1 is converted into a linear motion of the rod 14-1 in the manipulation rod system 14 by means of an ear shaft 14-5 which projects outwardly of the cylinder section 100-1 in the hydraulic coupling/decoupling device which is mounted at an end portion of the rod 14-1.

However, as pressurized oil acts upon the inside of the cylinder member 100-1 as described above, the rod 14-1 and the other rod 14-2 operate as a single rod and therefore, the rod 14-2 will move by an amount equal to the linear motion of the rod 14-1.

Figure 1:
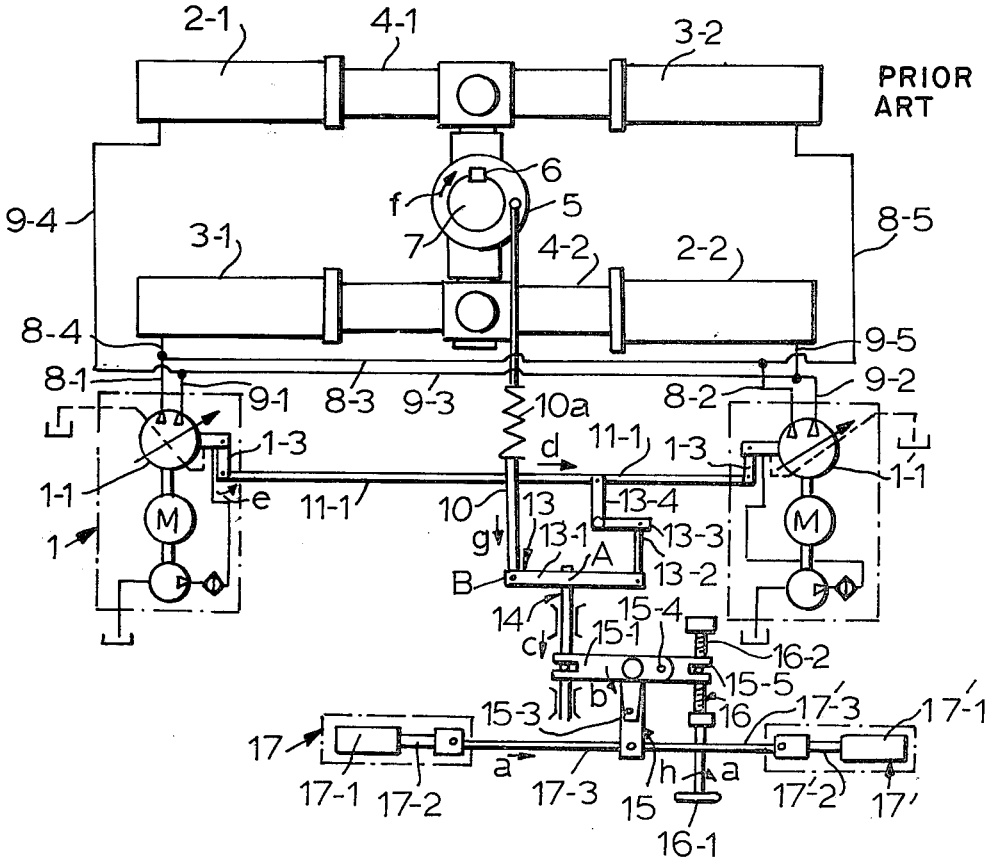
FIG. 1 is a schematic view of a marine steering arrangement of the prior art.

More particularly, the stroke motion of the piston rod 17-2, in the power unit 17, is itself transmitted to the pump control lever 1-3 through the manipulation arm system 15, the manipulation rod system 14, the floating arm system 13, the control rod 11, etc., in a manner which is similar to operation of the link mechanism of the prior art as shown in FIG. 1, and thereby, the slant plate of the pump 1-1 is inclined to turn the rudder.

When the rudder is turned in the above-described manner, the amount of steering done is fed back from the tiller 5, through the tracing rod 10, to the floating arm 13-1, so that the control lever 1-3 of the pump 1-1 is restored to its neutral position by the action of the floating arm 13-1, and the rudder stops at a commanded steering angle.

On the other hand, since the other tracing step 10′ is mounted on the tiller 5 of the steering machine, the amount of steering is also fed back to the other floating arm 13′-1 through the tracing rod 10′. However, as a result of the rod 14′-2 in the manipulation rod system 14′ which is associated with the hydraulic coupling/decoupling device 100' that is connected to the floating arm 13'-1 being able to move freely within a cylinder member which is positioned at an end portion of the other rod 14'-1, the stroke motion of the rod 14'-2 is not transmitted to the rod 14'-1. This is because the electromagnetic valve 18 is held at a position 18-2 by the excitation of the electromagnetic coil **18-*b*, and thereby, the oil within the cylinder member can flow freely into and out of a tank, through the pipe 25 and the return pipe 26**.

In addition, the oil held between the piston portion at an end of the manipulation rod 14'-2 and the free piston can also freely flow into and out of the tank through the return pipe 27'. More particularly, since the feedback signal, which represents the amount of steering that is transmitted through the tracing rod 10' to the floating arm 13'-1 is absorbed by the free motion of the manipulation rod 14'-2 which is connected to the floating arm 13'-1, the feedback signal is not transmitted to the control lever 1-3 of the pump 1-1 through the connecting rod 12.

Accordingly, at the pump 1-1, the feedback signals from the tracing rods 10 and 10' in the two channels would not be received simultaneously, however, feedback is always effected through the tracing rod in one channel, so that the influence of the tracing rod 10', which is caused by mechanical errors such as looseness in the link mechanism connecting the power unit with the pumps 1-1 and 1'-1, can be eliminated, and as a result, hunting of the slant plate in the pump 1-1, or more specifically, hunting in the steering angle can be completely prevented.

It is noted that in the case where the pump unit 1' for driving the steering machine, and the power unit 17' for remote manipulation, are used in combination, the electromagnetic valve 18 is switched to the position 18-1 by excitation of the electromagnetic coil **18-*a*, so that the manipulation rod system 14', which is associated with the hydraulic coupling/decoupling device 100', is hydraulically locked, and the other manipulation rod system 14** is freed.

Accordingly, the feedback signal of the amount of steering done, which is being transferred to the pump 1'-1, is effected only through the tracing rod 10', while the feedback signal from the other tracing rod 10 is absorbed by the now freed manipulation rod system 14, so that this feedback signal is not transmitted to the control lever 1'-3 which controls the pump 1'-1, and as a result, hunting of the slant plate of the pump 1'-1, or more specifically, hunting in the rudder can be prevented as described above.

Directing attention now, to the case where the pump unit 1 and the power unit 17' are used in combination, when a pump for the power unit 17' is started, in relation thereto, the electromagnetic valve 18 is switched to the position 18-1 by the excitation of the electromagnetic coil **18-*a***.

In addition, in response to the start of the pump unit 1, pilot pressurized oil from the auxiliary pump 1-4 in the pump unit 1 is fed to the pipe 23 through the pipe 19 and the check valve 21, and then fed to the manipulation rod system 14' which is associated with the hydraulic coupling/decoupling device 100' through the position of electromagnetic valve 18, which is in position 18-1, and the pipe 25. In a similar manner to the aforedescribed case, the rods 14'-1 and 14'-2 are locked together by the pilot pressurized oil, and thereby, the respective rods 14'-1 and 14'-2 can be actuated as a single unitary rod.

On the other hand, since the oil, within the manipulation rod system 14 which is associated with the hydraulic coupling/decoupling device 100, can flow freely into and out of the tank through the pipe 24, the electromagnetic valve 18 in position 18-1 and the return pipe 26, the manipulation rods 14-1 and 14-2 are freed relative to each other, and thereby, the operation of these rods as a single unit is eliminated.

In the aforedescribed condition, if a steering signal is applied from the bridge to the steering arrangement, then the piston rod 17'-2 in the power unit 17' moves in a stroke motion which corresponds to the steering signal. The stroke motion is transmitted through the intermediate rod 17'-3, the steering arm system 15', the manipulation rod system 14' which is associated with the hydraulic coupling/decoupling device 100', the floating arm system 13', the connecting rod 12 and the control rod 11, to the control lever 1-3 for the pump 1-1. As a result, the pump 1-1 discharges pressurized oil into the steering machine hydraulic cylinders 2-1, 2-2 or 3-1, 3-2 and thereby turns the rudder.

In response to this turning of the rudder, a feedback signal corresponding to the amount of steering, is fed back to the floating arm 13'-1 through the tracing rod 10', and, on the basis of the action of the floating arm 13'-1, the control lever 1-3 of the pump 1-1 is restored to its neutral position so that the rudder stops at the commanded steering angle.

Although the amount of steering is also fed back to the floating arm 13-1 through the other tracing rod 10, and since the rod 14-2 in the manipulation rod system 14 which is associated with the hydraulic coupling/decoupling device 100 that is connected to the floating arm 13-1 can move freely relative to the other rod 14-1, as described above, the above-described feedback stroke can be perfectly absorbed by the hydraulic coupling/decoupling device 100, and therefore, the stroke is not transmitted to the control lever 1-3 for the pump 1-1.

Accordingly, hunting in the pump 1-1 which is caused by the feedback signal which is transmitted through the tracing rod 10, and errors in the mechanical system, can be prevented, and as a result, hunting in the rudder can be prevented.

Further, an explanation can be made in a similar manner with respect to the case where the pump unit 1' and the power unit 17 are used in combination.

More particularly, in this case, since the electromagnetic valve 18 is switched to the position 18-2 an excitation of the electromagnetic coil **18-*b*, the manipulation rod system 14 which is associated with the hydraulic coupling/decoupling device 100 is locked by the pressurized oil. As a result, the manipulation rods 14-1 and 14-2 operate as a single rod, whereas the other manipulation rod system 14' is released from the hydraulic locking, so that the manipulation rods 14'-1 and 14'-2** are mechanically freed.

Accordingly, the feedback signal to the pump 1'-1 is effected through the tracing rod 10, and it is not effected through the other tracing rod 10'.

Furthermore, when the remote manipulation device from the bridge (including the power unit) breaks down or has a fault therein, the steering must be carried out by means of a mechanical handle 16-1 or 16'-1 in the steering machine chamber. Explaining now the operation of the device in this particular case, it becomes necessary to only consider that the mechanical handle 16-1 is used in place of the power unit 17, or that the mechanical handle 16'-1 is used in place of the power unit 17', and the operation is exactly the same as described in the previously discussed cases.

However, in this case there is a requirement that the electromagnetic valve 18 be actuated by means of a mechanical lever 18-3, and after the pin 15-4 or 15'-4, in the manipulation arm system 15 or 15' which is intended to be used, has been inserted, the pin 15-3 or 15'-3 is removed.

In the previously described cases where the pump units 1 and 1', for driving the steering machine and the power units 17 and 17' for the remote manipulation device, are used in various combinations, the activities of the respective units and respective members are shown in the following table.

control by means of the electromagnetic valve 18 is not hampered.

In addition, in the case where the electromagnetic valve 18 has become faulty, an electric power is supplied at once from the bridge to the electromagnetic valve 18' in the spare control circuit, and at the same time the electromagnetic valve 34 is excited and displaced to its position 34-1, and further, the electromagnetic valve 34' is no longer excited and restored to its position 34'-2.

Accordingly, the hydraulic switching valve 35 is displaced to its position 35-1 by the pressurized oil fed through the pipe 23, and thereby, blocks flow through the pipes 24 and 25.

At this moment, since the oil in the hydraulic path 36' escapes through the drain hydraulic path 37' into the

| | Pump Units | | Power Units | | Mechanical Handles | | Positions of Electromagnetic Valve 18 | | Manipulation Rod Systems associated with Hydraulic Coupling/Decoupling Devices | | Tracing Rods | |
|---|---|---|---|---|---|---|---|---|---|---|---|---|
| Case | 1 | 1' | 17 | 17' | 16-1 | 16'-1 | 18-1 | 18-2 | 14 | 14' | 10 | 10' |
| 1 | O | | O | | Δ | | | O | Lock | Free | O | |
| 2 | | O | | O | | Δ | O | | Free | Lock | | O |
| 3 | O | | | O | | Δ | O | | Free | Lock | | O |
| 4 | | O | O | | Δ | | | O | Lock | Free | O | |

It is noted that in the case where the mechanical handle 16-1 or 16-1 in the steering machine chamber is to be manipulated, the mechanical handle 16-1 or 16'-1, which is marked by Δ in the above table, should be used in place of the power unit 17 or 17' which is marked by O in the same table in the respective cases, and the use of the other units and members should follow in accordance to the above table.

The marine steering arrangement according to the second through seventh preferred embodiments of the present invention, are respectively illustrated in the schematic views of FIGS. 5 through 10, and in these figures, reference figures similar to those used in FIG. 2 designate substantially similar component parts.

Figure 5:
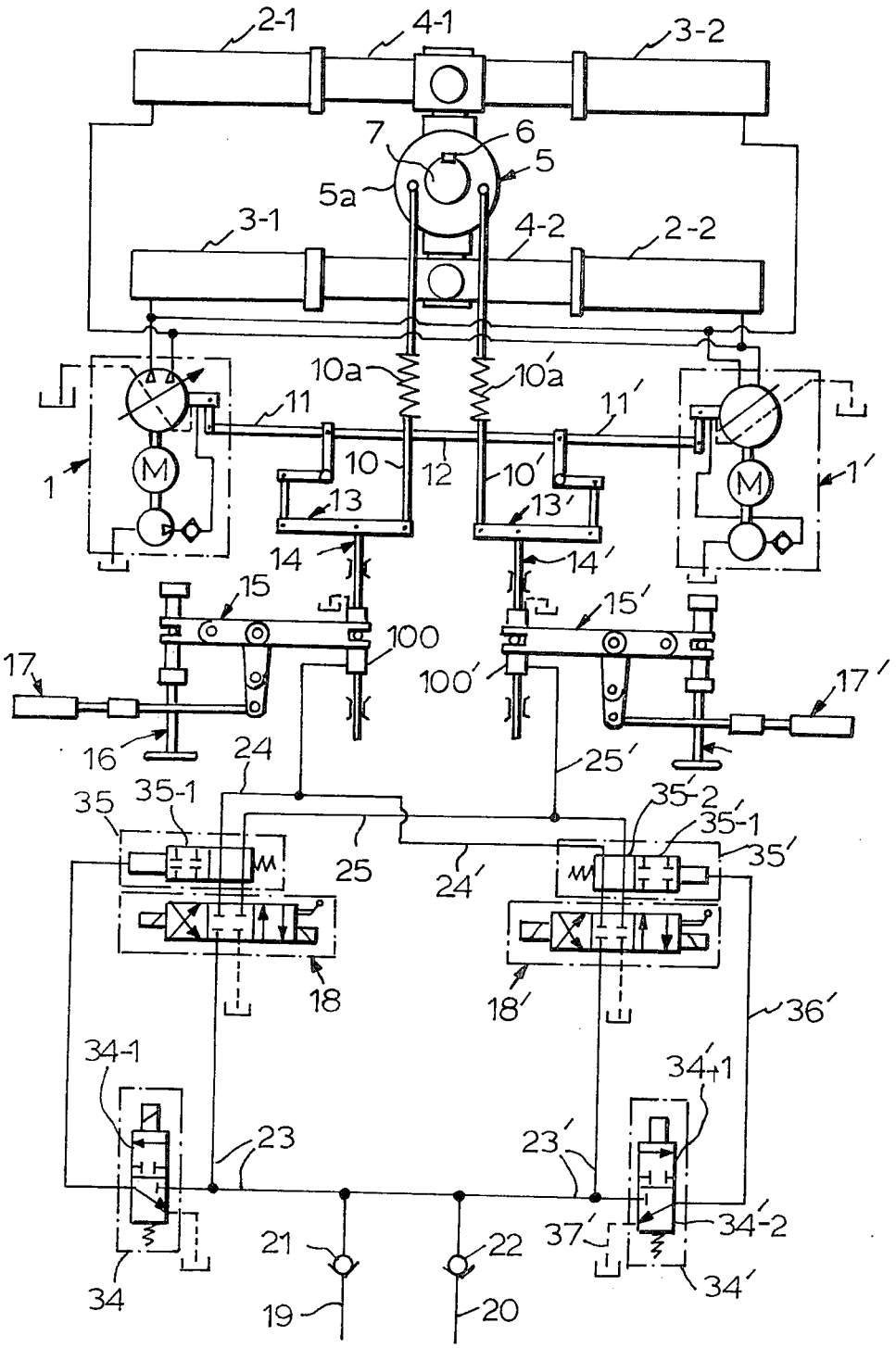
Figure 6:
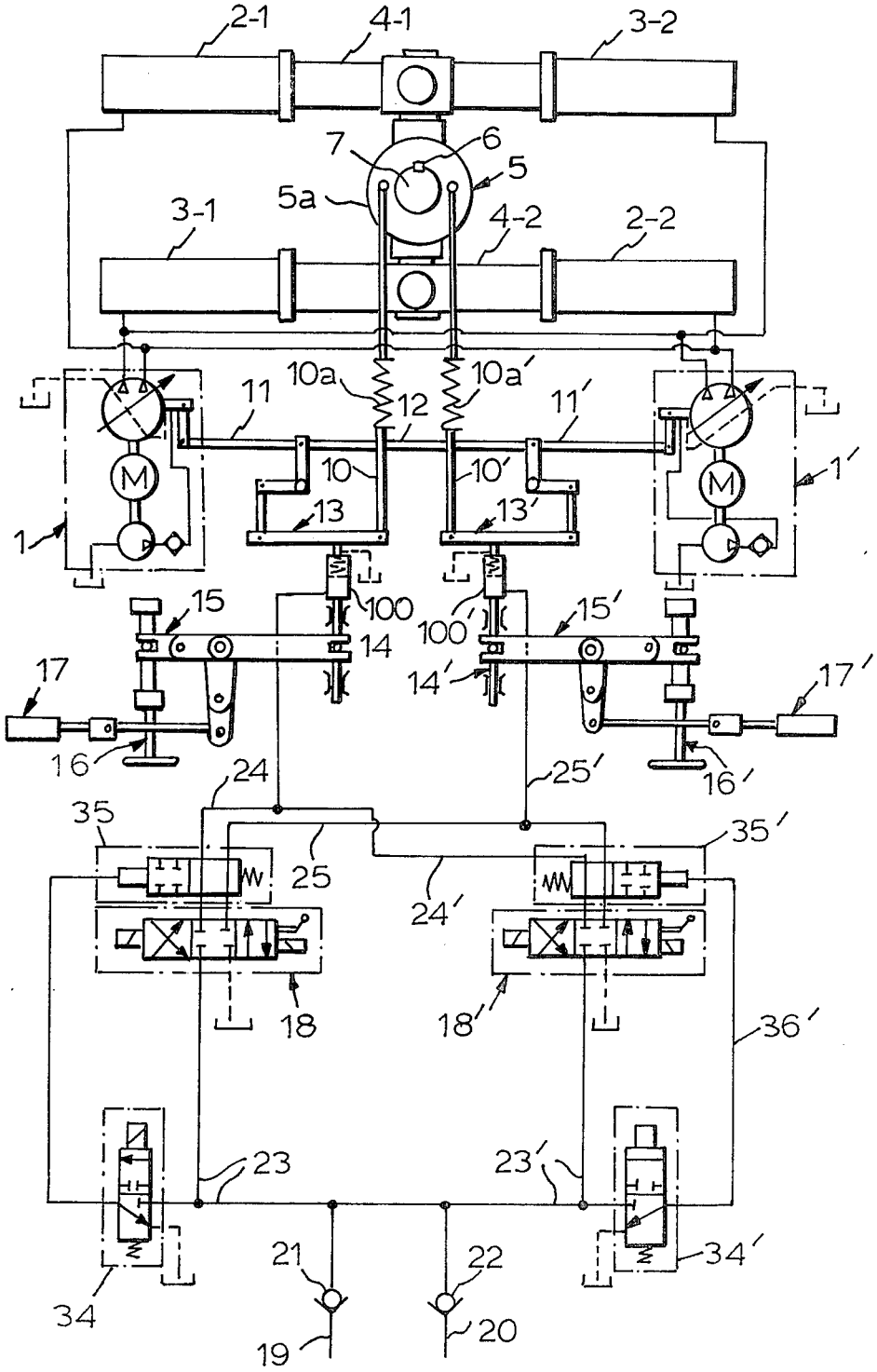
Figure 7:
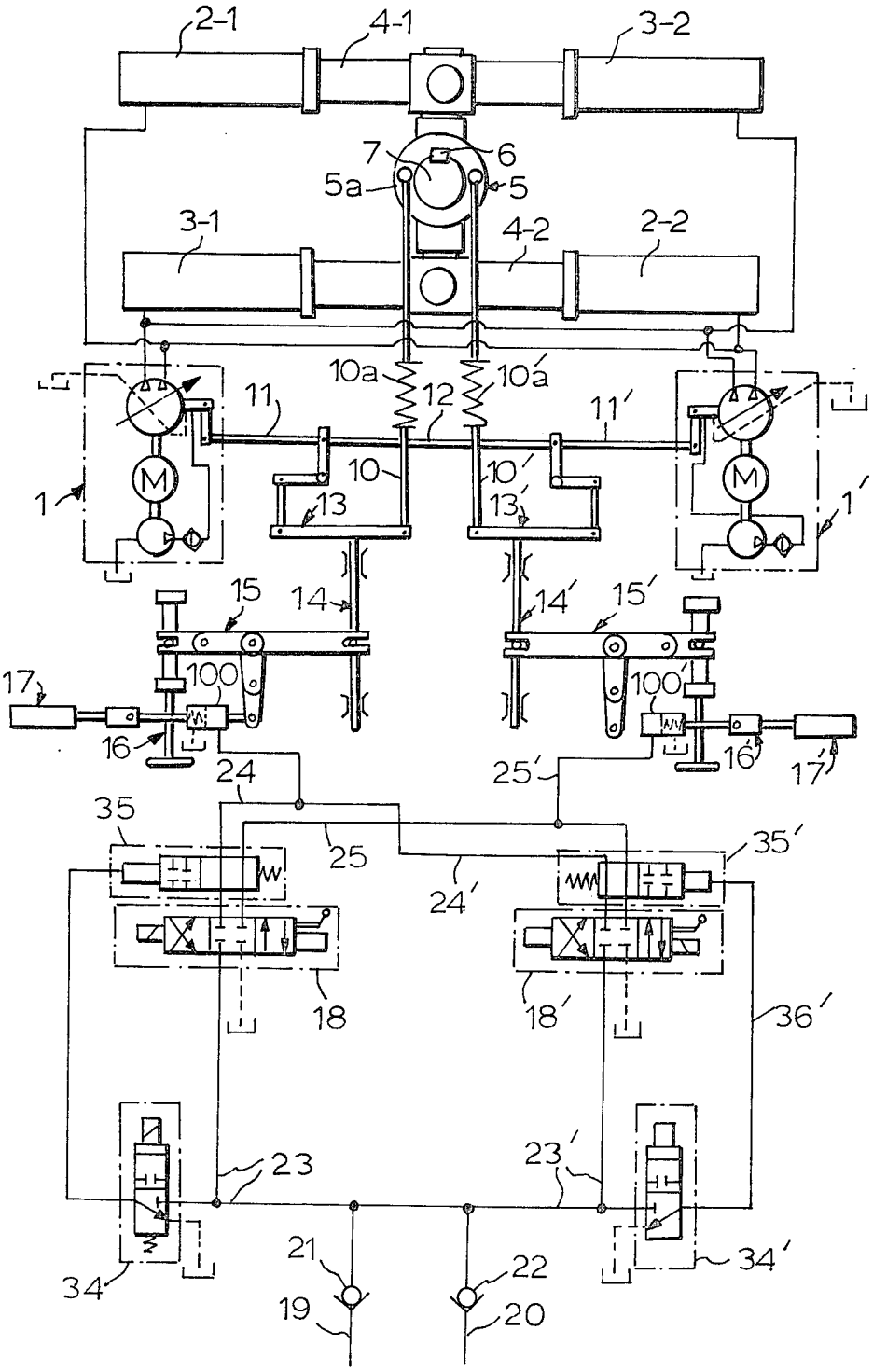
Figure 8:
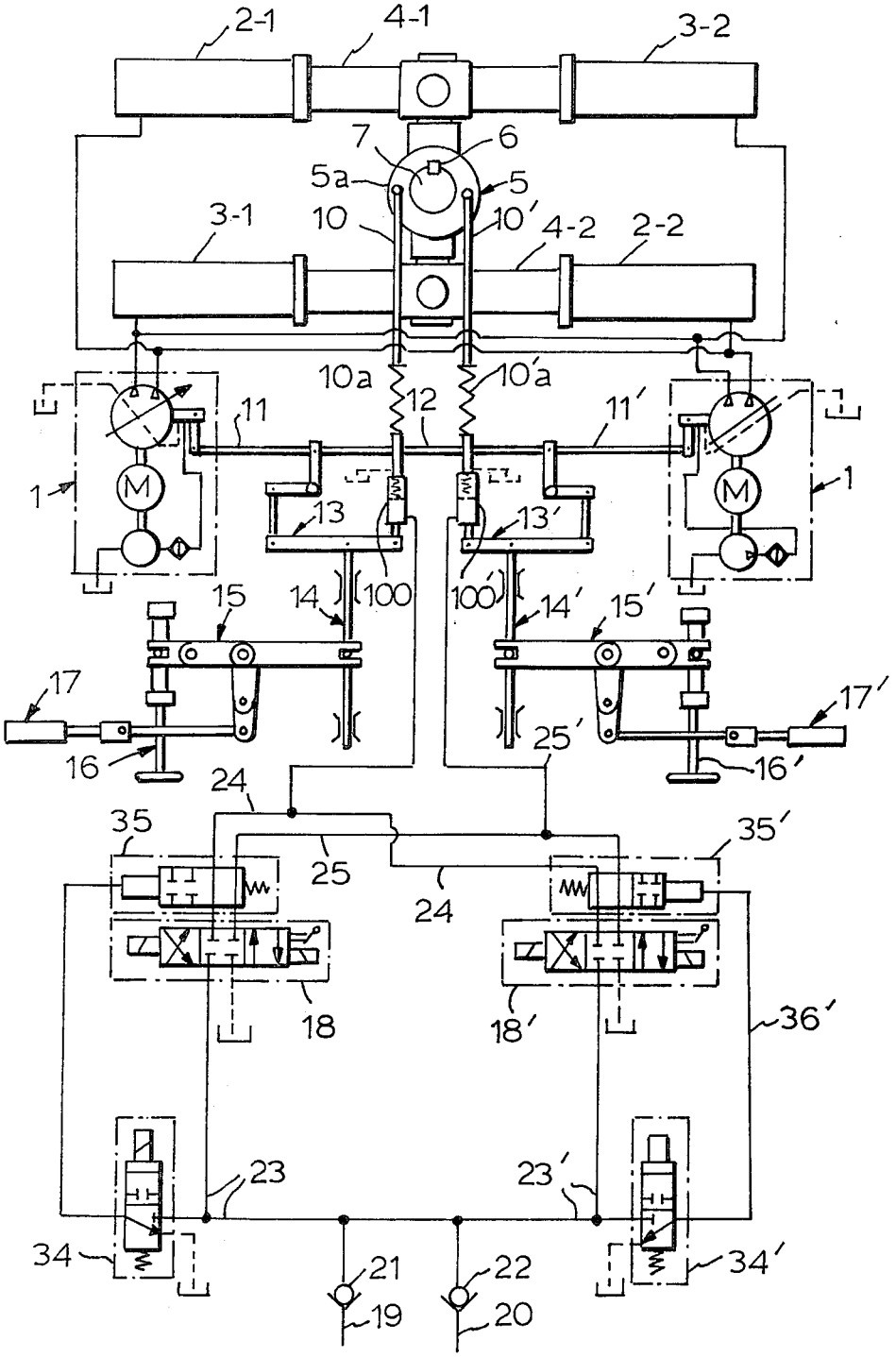
Figure 9:
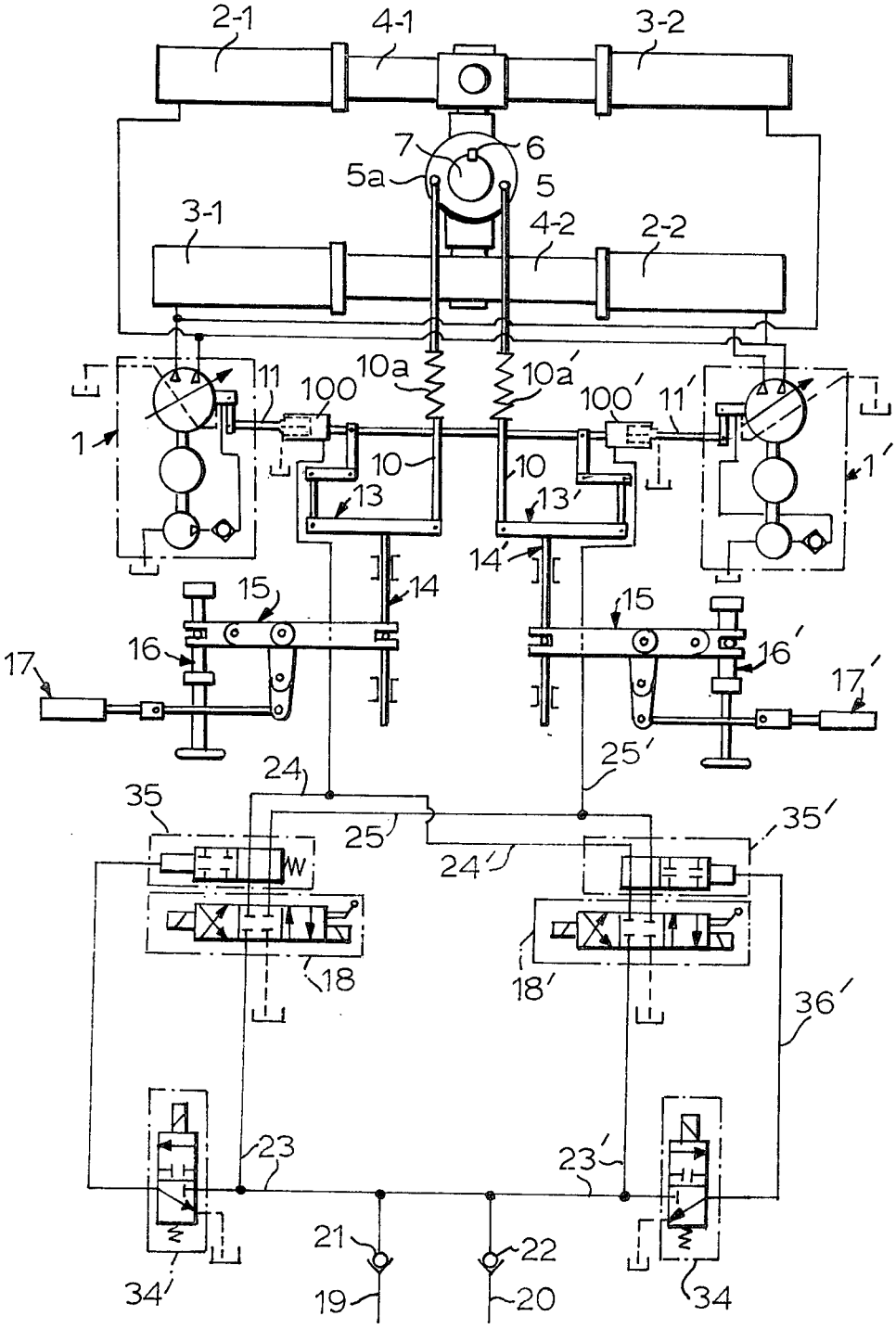
Figure 10:
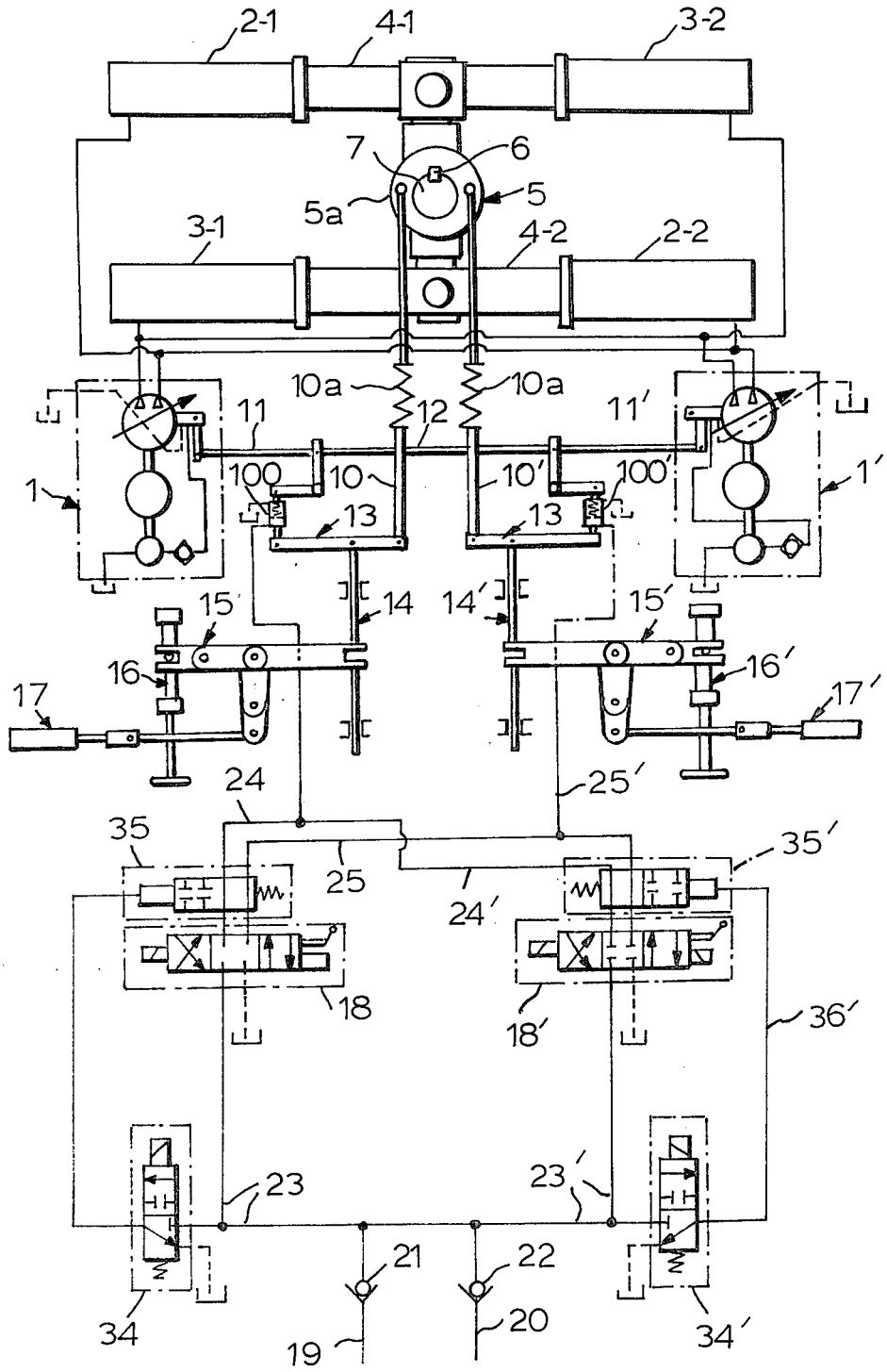

In the second preferred embodiment which is illustrated in FIG. 5, an additional electromagnetic valve 18' is further added to the first preferred embodiment, which is illustrated in FIG. 2, to double the hydraulic control system for the hydraulic coupling/decoupling devices 100 and 100', and thereby, the degree of safety in operation of the device is further enhanced.

In this modification, the addition of the electromagnetic valves 34 and 34', and hydraulic switching valves 35 and 35' is for the purpose of making the control of the device possible, with an additional normal hydraulic control system, even if either one of the electromagnetic valves 18 and 18' should become inoperative at a switched condition in either direction.

Presently, the modified embodiment will be described in greater detail. When the electromagnetic valve 18 is in use, the electromagnetic valve 34' is also excited, so that the electromagnetic valve 34' is in its position 34'-1.

Subsequently, the pressurized oil in the pipe 23' acts upon the hydraulic switching valve 35' through a hydraulic path 36', and thereby, switches the hydraulic switching valve 35' to the position 35'-1 to normally block flow through the pipes 24' and 25'.

Accordingly, regardless of the position in which the electromagnetic valve 18' becomes inoperative, the tank, the hydraulic switching valve 35' takes the position 35'-2, and thus makes it possible to control the hydraulic coupling/decoupling devices 100 and 100' by means of the electromagnetic valve 18'.

It is noted that the operation and effect of the mechanical control means in this case are similar to those in the above-described case.

Furthermore, in place of the interposition of the hydraulic coupling/decoupling devices 100 and 100' at the coupling portions between the manipulation rod systems 14 and 14' and the manipulation arm systems 15 and 15' as shown in FIG. 5, the hydraulic coupling-/decoupling devices 100 and 100' can be interposed in any one of the control force transmission systems in the respective mechanical control means, as shown in FIGS. 6 through 10, respectively.

It is a matter of choices that even if the hydraulic coupling/decoupling devices 100 and 100' are disposed as shown in FIGS. 6 through 10, respectively, the aforedescribed operation and effect can be fully achieved.

Figure 11:
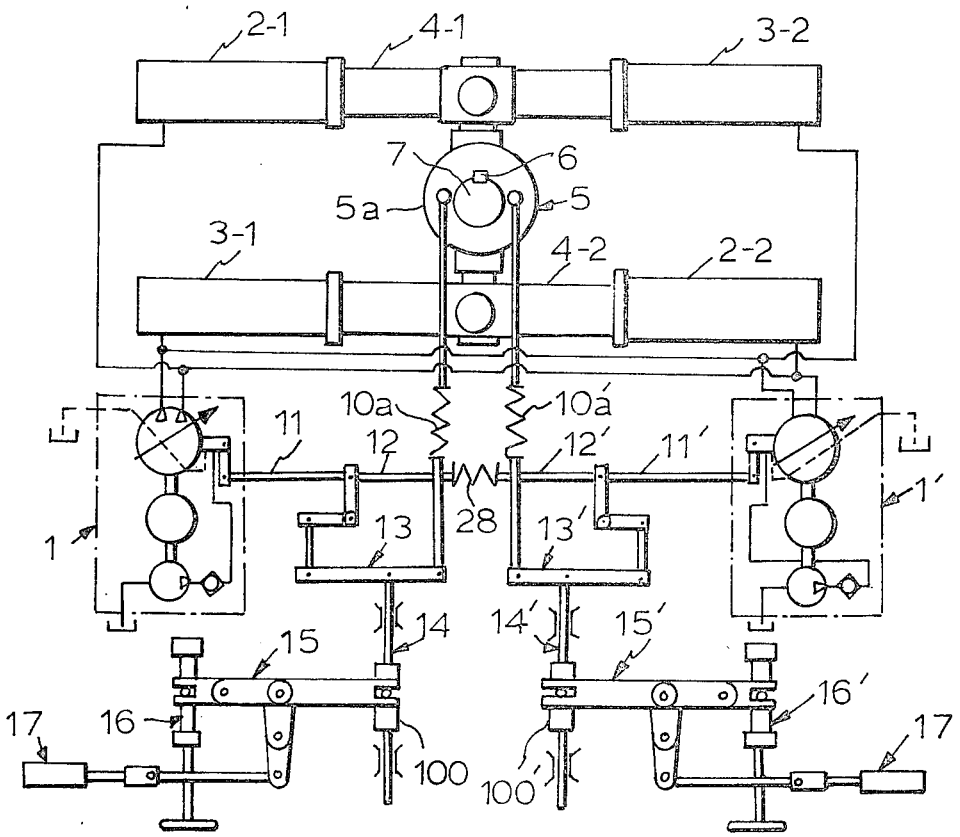
FIG. 11 is a schematic view of an eighth embodiment of the present invention.
Figure 12:
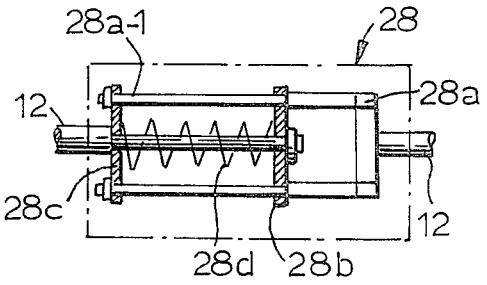
FIG. 12 is a longitudinal cross-section view of an absorbing spring in the embodiment of FIG. 11.
Figure 13:
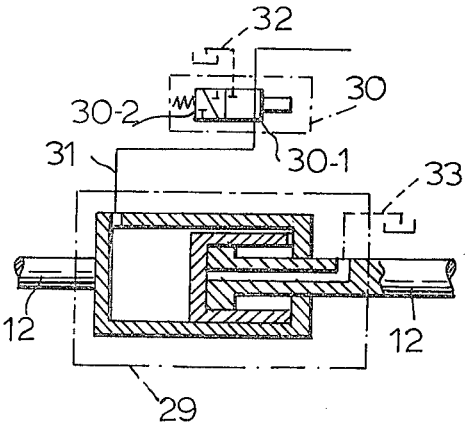
FIG. 13 is a longitudinal cross-section view of a hydraulic coupling/decoupling device in the embodiment of FIG. 11.

A marine steering arrangement according to an eighth preferred embodiment of the present invention is illustrated in FIGS. 11 through 13, FIG. 11 being a schematic view, FIG. 12 being a longitudinal cross-section view of an absorbing spring that is present in the arrangement, and FIG. 13 is a longitudinal cross-section view of a hydraulic coupling/decoupling device which is present in the arrangement. In FIG. 11, the same reference numerals as those used in FIGS. 5 through 10 designate substantially equivalent component parts, and in FIG. 13 the same reference numerals as those used in FIGS. 3 and 4 also designate substantially equivalent component parts.

In the eighth preferred embodiment, there is an absorbing spring 28, in the middle of the connecting rod 12 which connects the control rods 11 and 11' as illustrated in FIG. 12. As a result, in the case where the mechanical control means in the channel which is not in use becomes fixedly locked for any reason, the control for the pumps 1-1 and 1'-1 can be fully effected by the other mechanical control means, and thereby, the degree of safety is further enhanced with respect to the aforedescribed respective embodiments.

More particularly, as shown in FIG. 12, the absorbing spring 28 includes a casing 28*a* which is mounted on the connected rod 12 on the side of the control rod 11', two spring receptacle members 28*b* and 28*c* which are slidable relative to guide bars 28*a*-1 of the casing 28*a*, and a main spring body 28*d* which is interposed between the respective spring receptacle members 28*b* and 28*c*.

In addition, a reduced-diameter portion of the connecting rod 12, on the side of the control rod 11, operatively connects the respective spring receptacle members 28*b* and 28*c* to each other.

It is noted that the resilient force of the main spring body 28*d* is determined so that the main spring body 28*d* does not yield under a normal control force.

Due to the aforedescribed provision, even if the mechanical control means which includes, for example, the control rod 11', should become fixedly locked for any reason, the contraction effect of the absorbing spring 28 on the side of the control rod 11 serves to allow the control rod 11 to operate despite the fact that the side of the control rod 11' is fixed, and therefore, the pump 1-1 can be controlled by only the mechanical control means which includes the control rod 11.

Alternatively, in place of the aforedescribed absorbing spring 28, a hydraulic coupling/decoupling device 29, as shown in FIG. 13, is interposed in the middle of the connecting rod 12 and there is also provided an electromagnetic valve 30 which is excited only when the pump unit 1 and the power unit 17', (or the mechanical handle transmission system 16'), are used in combination, or the pump unit 1' and the power unit 17, (or the mechanical handle transmission system 16), are used in combination, so that the pressurized oil, which is fed from the auxiliary pump 1-4 or 1'-4 in the pump unit 1 or 1', acts upon the hydraulic coupling/decoupling device 29 through the position 30-1 of the electromagnetic valve 30, and by locking the device 29, the control rods 11 and 11' can be mechanically connected.

Further, in the case where the pump unit 1 and the power unit 17 are used in combination, or the pump unit 1' and 17' are used in combination, the electromagnetic valve 30 is released from excitation and the oil in the hydraulic coupling/decoupling device 29 can flow freely into and out of the tank through the position 30-2 of the electromagnetic valve 30, so that the control rods 11 and 11' can be mechanically freed relative to each other.

Still further, control circuit 65, as shown in FIG. 2, controls the electromagnetic valve 30 which is shown in FIG. 13, so that it switches from position 30-2 to position 30-1 and switches from 30-1 to 30-2 according to the condition of the circuit 65.

In other words, by adding the coupling/decoupling device 29, as described above, to the middle of the connecting rod 12, and also, by adding the electromagnetic valve 30 and the pipes 31 through 33, substantially the same operation as that of the absorbing spring 28 results in the steering arrangement, and thereby, a great improvement in safety can be expected.

As described in detail above, the marine steering arrangement according to the present invention provides the following effects and advantages:

(1) Since mechanical control means connecting the variable discharge type pump unit for driving the hydraulic steering machine to the power unit for remote manipulation thereof, (or the mechanical handle transmission system), are provided in at least two channels, even if one of the two channels should become faulty, the steering can be continuously effected through the other channel.

(2) No limitation is imposed upon the combination of the pump unit and the power unit, (or the mechanical handle transmission system), to be used, but any combination can be used. Accordingly, the effect of the defects in one unit upon the entire system is reduced, and the degree of safety is greatly enhanced.

(3) Even if any fault should arise in one channel of the mechanical control means which connects the pump unit and the power unit (or the mechanical handle transmission system), the steering can be automatically continued by merely switching the power unit which is used through remote manipulation from the bridge.

What is claimed is:

1. A marine steering construction comprising:

two parallel interconnection means operatively connected to a hydraulic steering machine, one of said parallel interconnection means being a spare interconnection means, and said two parallel interconnection means including respective first and second variable discharge pump units for being operatively connected to the hydraulic steering machine for actuating the hydraulic steering machine;

first and second power units operatively connected respectively to said first and second variable discharge pump units for causing said first and second variable discharge pump units to operate, said two parallel interconnection means including control force transmission systems and said control force transmission systems respectively connected to said first and second variable discharge pump units;

said control force transmission systems having respective mechanical control means connected thereto and said respective mechanical control means respectively mechanically connected to said first and second power units and to said first and second variable discharge pump units for transmitting a control force from said power units to respective variable discharge pump units;

hydraulic coupling/decoupling devices included in respective ones of said parallel interconnection means, said hydraulic coupling/decoupling devices located for connecting a respective mechanical control means to a respective control force transmission system, said hydraulic coupling/decoupling devices being operative for switching said control force transmission systems from a first state wherein said control force can be transmitted from said power units and control means to said variable discharge pump units for actuating said pump units, to a second state wherein said control force cannot be transmitted;

mechanical feedback means connected between said parallel interconnection means and to the hydraulic steering machine for transmitting a feedback from the steering machine which corresponds to an amount of steering done, to respective ones of said first and second variable discharge pump units and first and second power units; and a rod connecting said parallel interconnection means to each other for relating and synchronizing the operation of said control means, said rod having absorbing means disposed therein for absorbing excessive forces generated as a result of defective operating conditions.

2. A marine steering construction as claimed in claim 1 wherein said absorbing means comprises a spring.

3. A marine steering construction as claimed in claim 1 wherein said absorbing means comprises a hydraulic coupling/decoupling device.

4. A marine steering construction as claimed in claim 1 further comprising an electromagnetic valve connected to said hydraulic coupling/decoupling devices for controlling said hydraulic coupling/decoupling devices and a control circuit electrically connected to said electromagnetic valve for actuating said electromagnetic valve in accordance with the start/stop condition of said power units.

* * * * *